US011281161B2

(12) United States Patent
Dauby et al.

(10) Patent No.: US 11,281,161 B2
(45) **Date of Patent: *Mar. 22, 2022**

(54) RUNNING EQUATION OF TIME MECHANISM CONTROLLED BY A DIFFERENTIAL DEVICE

(71) Applicant: Montres Breguet S.A., L'Abbaye (CH)

(72) Inventors: Sylvain Dauby, Le Sentier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 594 days.

This patent is subject to a terminal disclaimer.

(21) Appl. No.: 16/221,023

(22) Filed: Dec. 14, 2018

(65) Prior Publication Data

US 2019/0121293 A1 Apr. 25, 2019

Related U.S. Application Data

(63) Continuation of application No. 15/591,141, filed on May 10, 2017, now Pat. No. 10,254,714.

(30) Foreign Application Priority Data

Jul. 15, 2016 (EP) ..... 16179617

(51) Int. Cl.
*G04B 19/02* (2006.01)
*G04B 49/00* (2006.01)
(Continued)

(52) U.S. Cl.
CPC ..... *G04B 19/025* (2013.01); *G04B 19/262* (2013.01); *G04B 49/00* (2013.01); *G04B 19/24* (2013.01); *G04B 27/001* (2013.01)

(58) Field of Classification Search
CPC ..... G04B 19/025; G04B 19/23; G04B 19/24; G04B 19/26; G04B 19/262; G04B 49/00
See application file for complete search history.

(56) References Cited

U.S. PATENT DOCUMENTS 10,254,714 B2 * 4/2019 Dauby ..... G04B 19/262
2003/0031093 A1 * 2/2003 Zaugg ..... G04B 19/23 368/80

(Continued)

FOREIGN PATENT DOCUMENTS

CH 689 359 A5 1/1996
CH 697 771 B1 6/2004

(Continued)

OTHER PUBLICATIONS

Coudray, Eric, English Translation of CH698613, originally published on Sep. 15, 2009, full document, retrieved from Espacenet on Jun. 19, 2021 (Year: 2009).*

(Continued)

*Primary Examiner* — Daniel P Wicklund
(74) *Attorney, Agent, or Firm* — Oblon, McClelland, Maier & Neustadt, L.L.P.

(57) ABSTRACT

A running equation of time mechanism includes civil hour and minute hands to indicate civil time and a concentric true minute hand to indicate true time. The running equation of time mechanism includes an equation of time cam and a differential gear device, a first input of which is formed by a civil minute pipe on which a civil minute hand is pressed, and a second input of which is formed by the equation of time cam. The differential gear device includes a planetary reducer wheel set via which the civil minute pipe drives a civil hour pipe on which is pressed the civil hour hand, and a planetary multiplier wheel set via which the civil hour pipe drives a true minute pipe on which is pressed the true minute hand.

3 Claims, 4 Drawing Sheets

(51) Int. Cl.

| | |
|---|---|
| ***G04B 19/26*** | (2006.01) |
| ***G04B 19/24*** | (2006.01) |
| ***G04B 27/00*** | (2006.01) |

(56) References Cited

U.S. PATENT DOCUMENTS

| | | | | |
|---|---|---|---|---|
| 2012/0243380 | A1* | 9/2012 | Goeller ..... | G04B 19/262<br>368/15 |
| 2012/0243388 | A1 | 9/2012 | Goeller | |
| 2014/0269219 | A1 | 9/2014 | Rochat | |
| 2015/0103635 | A1* | 4/2015 | Rochat ..... | G04B 19/235<br>368/17 |
| 2016/0124387 | A1 | 5/2016 | Neboisa et al. | |

FOREIGN PATENT DOCUMENTS

| | | | |
|---|---|---|---|
| CH | 698 613 | B1 | 9/2009 |
| EP | 1 637 941 | A1 | 3/2006 |
| EP | 1 637 942 | A1 | 3/2006 |
| EP | 2 778 800 | A1 | 9/2014 |

OTHER PUBLICATIONS

European Search Report dated Jan. 6, 2017 in European Application 16179617, filed on Jul. 15, 2016 ( with English Translation of Categories of Cited Documents).

* cited by examiner

RUNNING EQUATION OF TIME MECHANISM CONTROLLED BY A DIFFERENTIAL DEVICE

This application is a continuation of U.S. application Ser. No. 15/591,141, filed May 10, 2017, which claims priority from EP No. 16179617.2 filed on Jul. 15, 2016, the entire disclosure of each of which is hereby incorporated herein by reference.

FIELD OF THE INVENTION

The present invention concerns a running equation of time mechanism for a timepiece. More precisely, the invention concerns a running equation of time mechanism driving a minute hand for the true solar time concentric to the hands of the movement.

BACKGROUND OF THE INVENTION

It is well known that there is a difference between true solar time, which is the time that elapses between two consecutive meridian passages of the sun at the same location, and mean solar time or civil time which is the mean duration in a year of all the true solar days. This difference between civil time and true solar time reaches +14 minutes 22 seconds on 11 February and −16 minutes 23 seconds on 4 November. These values vary very little from year to year.

To indicate the time difference between civil time and true time, in addition to the hand that indicates the minutes of civil time, some timepieces include a so-called equation of time mechanism which includes a hand that moves opposite a graduated scale to indicate the difference between the minutes of civil time and the minutes of true solar time on a given day. This true solar minute hand is actuated by an equation of time cam whose profile is determined by the difference between the mean solar time and the true solar time on every day of the year.

Another mechanism for indicating the time difference between civil time and true time is known by the name of a 'running equation of time'. The hand arrangement of a timepiece equipped with a running equation of time mechanism comprises two concentric minute hands, one indicating the minutes of civil time and the other indicating the minutes of true time. At any moment, the distance between the civil minute hand and the true solar minute hand is determined by the difference between the mean solar time and the true solar time on the day of the year concerned. Like the equation of time mechanism, the true solar minute hand of a running equation of time mechanism is actuated by an equation of time cam.

The equation of time cam is driven in rotation at the rate of one revolution per year using either a simple or perpetual calendar mechanism. The simple calendar mechanism is arranged to indicate the day of the week, the day of the month, the month of the year or the phases of the moon, but does not take account of the variation in the number of days in the months (months of 28, 29 or 30 days). In other words, the user of a watch with a simple calendar mechanism will have to make a manual correction at the end of every month with less than 31 days. For example, on 28 February or 30 April, a manual correction will have to be made. The perpetual calendar mechanism, like the simple calendar mechanism, can indicate the day, the date, the month and the phases of the moon. However, unlike a simple calendar mechanism, a perpetual calendar mechanism automatically takes account of the length of the months (28, 29 and 30 days) without manual intervention. A perpetual calendar mechanism thus automatically takes account of leap years.

An example of a running equation of time mechanism is disclosed by EP Patent Application Publication No 1286233A1 in the name of the Applicant. FIG. 1 annexed to this patent application is taken from the aforementioned EP Patent Application Publication No 1286233A1 and illustrates a running equation of time mechanism driven by a differential device.

This Figure also shows an equation of time cam 1, whose profile is determined by the difference, on every day of the year, between the mean solar time or civil time and true solar time. This equation of time cam 1 is driven in rotation at the rate of one revolution per year using a simple or perpetual calendar mechanism contained in the timepiece. Equation of time cam 1 carries a month disc 2 which rotates at the same speed as cam 1 and which makes the position of equation of time cam 1 coincide with the date indicated by the calendar mechanism, so that the solar time minute hand 4 indicates the exact difference between the minutes of civil time and the minutes of true solar time.

The simple or perpetual calendar mechanism may be of any known type and will not be described in its entirety here. To ensure proper understanding, it is sufficient to know that this calendar mechanism drives equation of time cam 1 at the rate of one complete revolution per year. However, for the purpose of illustration only, a date wheel set 6 driving a hand 8 which indicates the date (from 1 to 31) is represented. This date wheel set 6 rotates at the rate of one complete revolution per month. It is actuated by the calendar mechanism and drives equation of time cam 1 via an intermediate date wheel 10 which can reverse the direction of rotation, and a reduction wheel set 12 which can reduce the rotational speed from one complete revolution per month to one complete revolution per year.

The solar minute hand 4 is driven by a differential gear device 14 which has as respective inputs a gear train driving a civil minute hand 18 and a rack 20 which cooperates with equation of time cam 1 (rack 20 is represented in FIG. 1 in both of its end positions, once in a solid line and the other time in dot and dash lines). More specifically, as seen in FIG. 1, differential gear device 14 includes at least one and preferably two planetary pinions 22 driven by the motion work of the watch movement. These two planetary pinions 22 are capable of rotating on themselves and rolling over the inner toothing 24 of an equation of time wheel 26. The latter also has, on the external periphery thereof, a first toothed sector 28 via which it cooperates with a second toothed sector 30 arranged on one of the ends of rack 20. This rack 20 is subjected to the return action of a spring (not represented) which is fixed to the watch frame and which tends to place a feeler spindle 32, forming the other end of rack 20, against the profile of equation of time cam 1. The solar time display gear train includes a solar time display pinion 34 placed at the centre of differential gear device 14. This solar time display pinion 34 meshes on one hand with planetary pinions 22, and carries, on the other hand, a solar time display wheel 38 which meshes with a cannon-pinion 40 onto the pipe of which solar minute hand 4 is pressed. This gear train 38, 40 returns the solar minute display to the centre 42 of the watch movement, so that the solar minute hand 4 is concentric with civil minute hand 18.

The running equation of time mechanism which has just been described operates as follows.

In the normal operating mode of the watch, equation of time cam 1, rack 20, and therefore equation of time wheel 26, are immobile. However, planetary pinions 22 are driven by the watch movement. Thus, they rotate on themselves and roll over the inner toothing 24 of equation of time wheel 26, driving solar time display pinion 34 in rotation, which allows solar minute hand 4 to rotate concomitantly with civil minute hand 18. The distance between solar minute hand 4 and civil minute hand 18 thus remains constant over a 24-hour period.

Once per day, at around midnight, equation of time cam 1 pivots, driven by the calendar mechanism which changes the date from one day to the next day. At that precise moment, feeler spindle 32, which is in contact with the profile of equation of time cam 1, in turn pivots rack 20. As it pivots, rack 20 drives equation of time wheel 26 in rotation. Planetary pinions 22, which are substantially immobile during this brief time interval (they make one complete revolution on themselves in one hour), rotate on themselves, driven in rotation by equation of time wheel 26, and in turn drive solar time display pinion 34 so as to precisely set the position of the solar minute hand again.

The running equation of time mechanism described above therefore makes it possible to display, at any time, the time difference between mean solar time and true time, by means of a civil minute hand and a solar minute hand. It is noted, however, that differential gear device 14 is not located at centre 42 of the watch movement. The design is therefore not symmetrical, which is counter-intuitive. Further, owing to the off-centre position of differential gear device 14, it is necessary to provide an additional gear train (solar time display wheel 38 and cannon-pinion 40) to return the solar time display to centre 42 of the watch movement and ensure concentricity between civil minute hand 18 and solar minute hand 4. The additional gear train occupies space and may cause failure.

SUMMARY OF THE INVENTION

It is an object of the present invention to overcome the problems described above in addition to others by providing a running equation of time mechanism controlled by a differential gear device which is more compact and thus easier to incorporate in a timepiece movement.

To this end, the present invention concerns firstly a running equation of time mechanism comprising a hand arrangement whose purpose is to indicate civil time by means of a concentric hour hand and minute hand, and a true minute hand concentric with the civil time hands, the running equation of time mechanism also including an equation of time cam having a profile which is determined by the difference, on each day of the year, between mean solar time or civil time, and apparent solar time or true time, this equation of time cam being driven in rotation at the rate of one revolution per year by a timepiece movement, the position of the true minute hand being determined by the position of the equation of time cam, the running equation of time mechanism also including a differential gear device, a first input of which is formed by a cannon-pinion integral with a civil minute pipe on which a civil minute hand is pressed, and a second input of which is formed by the equation of time cam, the differential gear device being arranged concentrically with respect to the true minute hand.

Secondly, the present invention concerns a running equation of time mechanism comprising a hand arrangement whose purpose is to indicate civil time by means of a concentric hour hand and minute hand, and a true minute hand concentric with the civil time hands, the running equation of time mechanism also including an equation of time cam having a profile which is determined by the difference, on each day of the year, between mean solar time or civil time, and apparent solar time or true time, this equation of time cam being driven in rotation at the rate of one revolution per year by a timepiece movement, the position of the true minute hand being determined by the position of the equation of time cam, the running equation of time mechanism also including a differential gear device whose first input is formed by a cannon-pinion integral with a civil minute pipe on which is pressed a civil minute hand, and whose second input is formed by the equation of time cam, the differential gear device including a planetary reducer wheel set, via which the civil minute pipe drives a civil hour pipe on which is pressed the civil hour hand, and a planetary multiplier wheel set via which the civil hour pipe drives a true minute pipe on which is pressed the true minute hand.

As a result of these features, the present invention provides a running equation of time mechanism which is driven by a differential gear device provided with a planetary reducer wheel set, via which the civil minute pipe drives a civil hour pipe on which is pressed the civil hour hand, and a planetary multiplier wheel set via which the civil hour pipe drives a true minute pipe on which is pressed the true minute hand. By proposing to integrate within the differential gear device the functions making it possible to produce the civil hour from the civil minute, and the true minute from the civil hour and from an equation of time cam, it is possible to obtain a more compact differential gear device, whose planetary reducer and multiplier wheel sets are returned to the centre of the watch movement. The differential gear device according to the invention is thus easier to house inside the timepiece movement to which it is fitted, which makes it possible to reduce the dimensions of the timepiece movement and have more space available for housing the other components of the movement.

According to a preferred embodiment of the invention, the planetary reducer wheel set and the planetary multiplier wheel set rotate on themselves describing a circular trajectory, preferably of the same radius, centred on the civil minute pipe.

The differential gear device according to the invention comprises fewer components and is therefore more reliable. Further, it exhibits a general radial symmetry centred on the centre of the movement, which facilitates its assembly and arrangement.

BRIEF DESCRIPTION OF THE DRAWINGS

Other features and advantages of the present invention will appear more clearly from the following detailed description of an example embodiment of a running equation of time device according to the invention, this example being given solely by way of non-limiting illustration with reference to the annexed drawing, in which.

DETAILED DESCRIPTION OF ONE EMBODIMENT OF THE INVENTION

The present invention proceeds from the general inventive idea consisting in equipping a running equation of time mechanism with a differential gear device which is capable of indicating both civil time, by means of a civil hour hand and a civil minute hand, and the true minute by means of a second minute hand concentric with the civil time hands. The respective power take-offs of the differential gear device are a going train wheel set of the timepiece movement on one hand, and an equation of time cam on the other hand. According to the invention, a gear reduction function that makes it possible to change from the civil minute to the civil hour, and a multiplier function that makes it possible to change from the civil hour to the true minute, are integrated into the differential gear device, which makes the running equation of time mechanism more compact and thus easier to arrange inside the timepiece movement.

Figure 1:
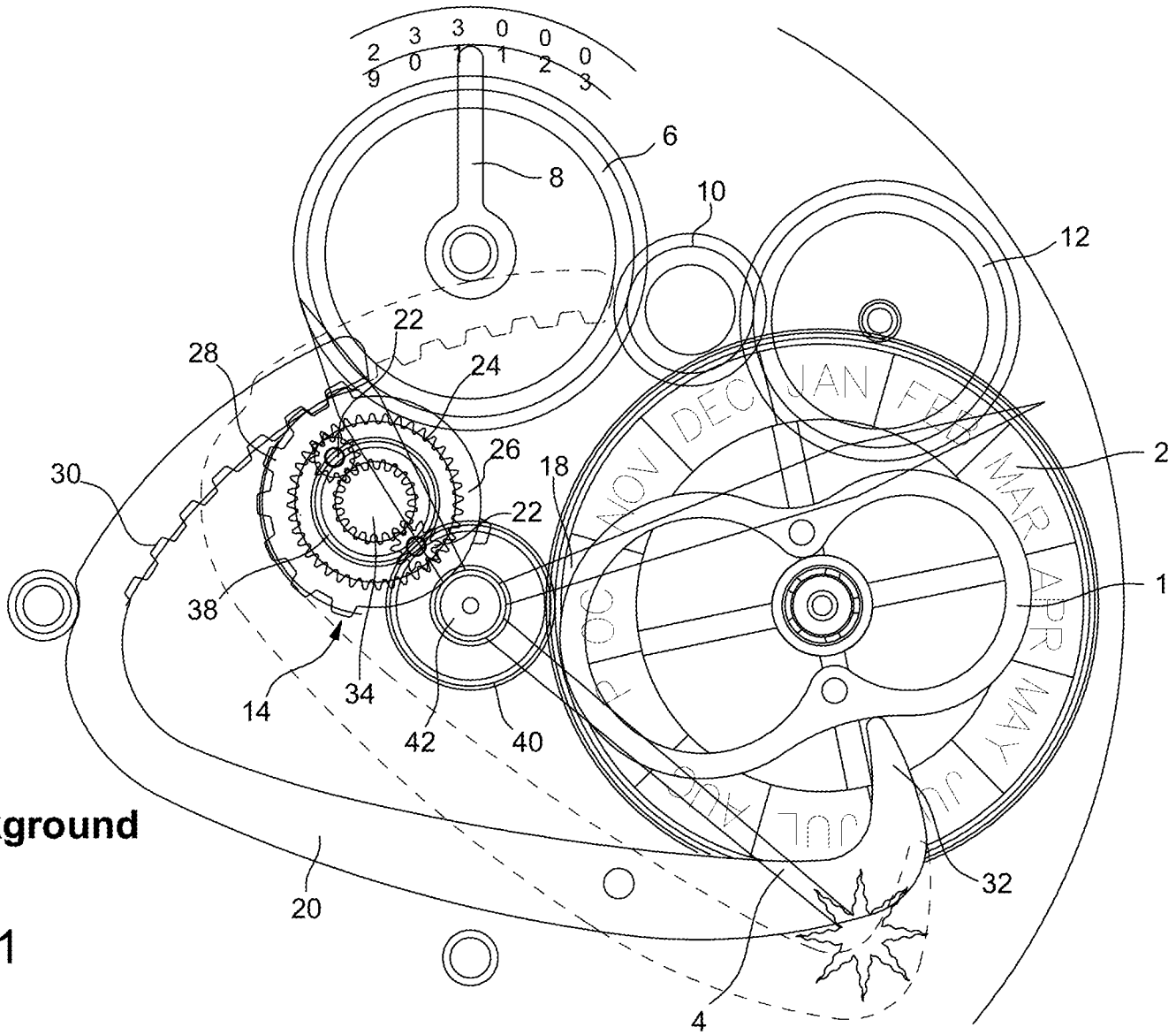
Background Art Fig. 1
FIG. 1, cited above, is a view of a running equation of time mechanism according to the prior art driven by a differential device.
Figure 2:
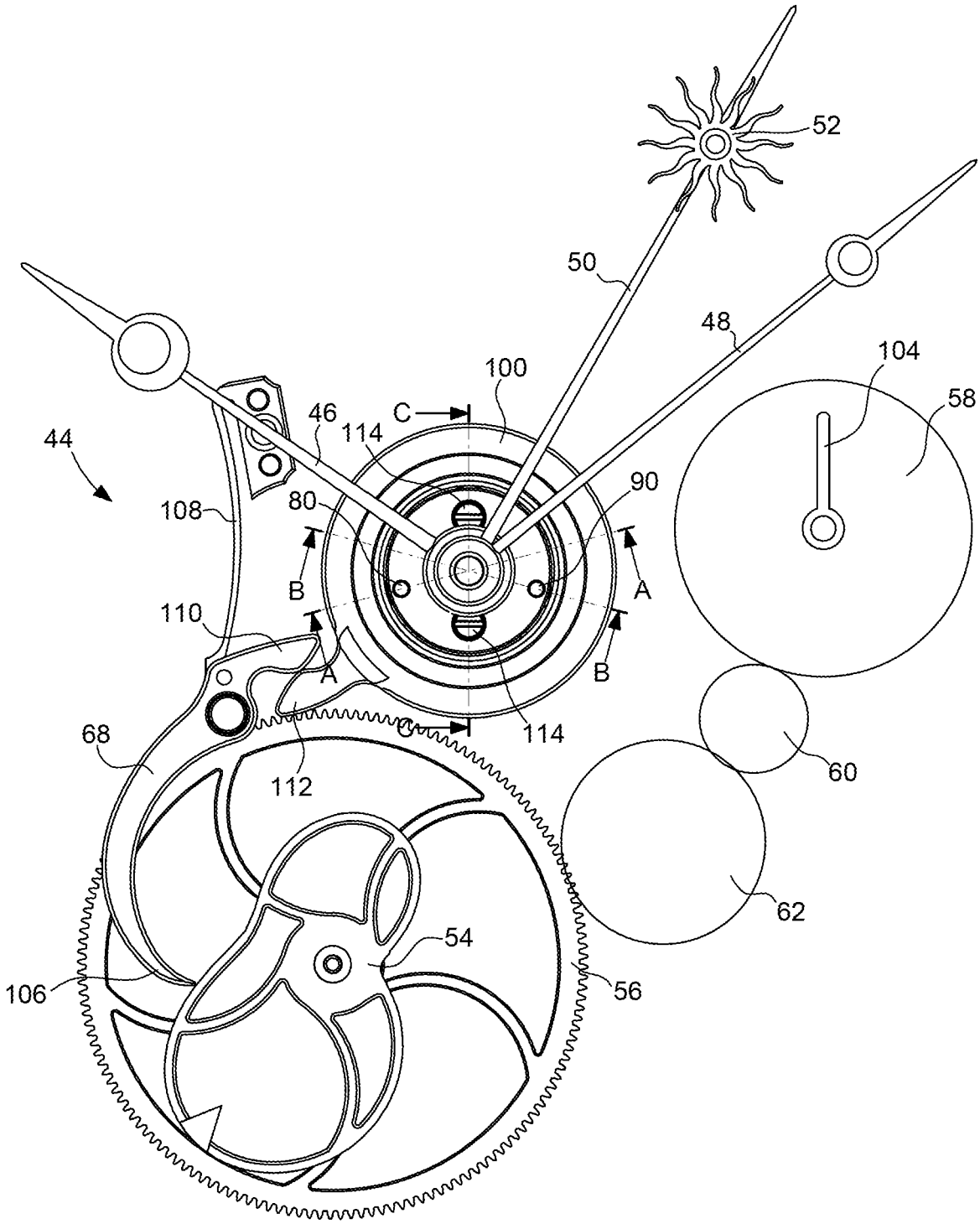
FIG. 2 is a top view of the running equation of time device according to the invention.

It is an object of the present invention to integrate in a timepiece, such as a wristwatch, a running equation of time mechanism, i.e. a mechanism whose hand arrangement includes two concentric minute hands, one indicating the civil minute and the other indicating the true minute. To this end, and as seen in FIG. 2, the running equation of time mechanism according to the invention, designated as a whole by the general reference numeral 44, includes on one hand a conventional hand arrangement whose purpose is to indicate civil time by means of an hour hand 46 and a minute hand 48, and on the other hand, a true minute hand 50, concentric with civil minute hand 48, and which indicates the true solar minute. To enable the wearer of the watch to easily tell the difference between civil minute hand 48 and true minute hand 50, the end of the latter may, for example, include a representation of the astrological symbol of the sun 52. As will be seen in detail in the following description, the exact position of the true minute hand 50 on a given day is determined once in 24 hours, around midnight, and then civil minute hand 48 and true minute hand 50 move in concert, the distance between these two hands 48 and 50 remaining constant for the given day.

FIG. 2 also shows a part of the running equation of time mechanism 44 according to the invention, and particularly an equation of time cam 54 whose profile, it should be recalled, is determined by the difference between mean solar time or civil time, and true time or solar time on every day of the year.

Referring again to FIG. 2, it is seen that equation of time cam 54 is secured to an equation of time wheel 56 which is driven at a rate of one complete revolution per year by a simple or perpetual calendar mechanism (not represented) comprised in the timepiece. The simple or perpetual calendar mechanism may be of any known type and will not be described in detail here. To ensure proper understanding of the invention, it is sufficient to know that this calendar mechanism drives equation of time wheel 56, to which equation of time cam 54 is secured, at the rate of one complete revolution per year. The calendar mechanism comprises a date wheel 58 that rotates at a rate of one complete revolution per month while driving a date indicator 104. Moreover, equation of time wheel 56 is driven by date wheel 58 via an intermediate date wheel 60 making it possible to reverse the direction of rotation, and a reduction wheel set 62 which can reduce the rotational speed from one complete revolution per month to one complete revolution per year.

Figure 3:
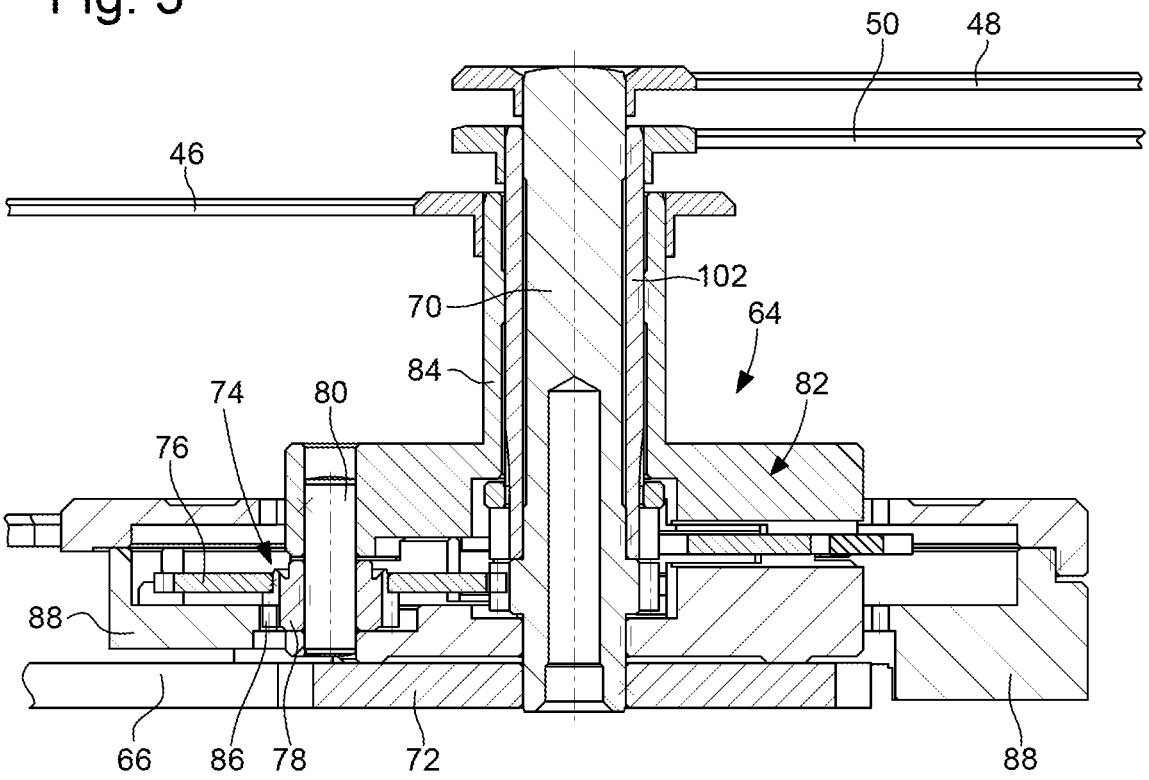
FIG. 3 is a cross-sectional view along line A-A of FIG. 2.

According to the invention, true minute hand 50 is driven by a differential gear device 64, whose respective inputs (see FIG. 3) are a wheel set 66 of a going train driving the civil minute hand 48 and an equation of time lever 68 which cooperates with equation of time cam 54. More precisely, as seen in FIG. 3, a civil minute pipe 70 is driven by going train wheel set 66 of the timepiece movement of the timepiece via a cannon-pinion 72 integral with civil minute pipe 70. In turn, civil minute pipe 70 drives a planetary reducer wheel set 74 formed by a first planetary wheel 76 and a first planetary pinion 78 integral with first planetary wheel 76.

Planetary reducer wheel set 74 is mounted to pivot about a first pin 80 driven into an upper differential frame 82 with which a civil hour pipe 84 onto which is pressed civil hour hand 46 is integral. Driven by civil minute pipe 70 via first planetary wheel 76, first planetary pinion 78 rolls over a first inner toothing 86 of a first differential crown wheel 88 which is carried by the timepiece movement and which is immobile. By rolling over first inner toothing 86 of immobile differential crown wheel 88, first planetary pinion 78 thereby pivots upper differential frame 82 and thus civil hour pipe 84 which is integral with upper differential frame 82. The right choice of gear ratios between civil minute pipe 70, first planetary wheel 76, first planetary pinion 78 and immobile differential crown wheel 88 produces a reduction of one twelfth between the minutes and hours of civil time and the civil time display is thus obtained. In other words, by a reduction of one twelfth, planetary reducer wheel set 74 makes it possible to change from the civil minute to the civil hour.

Figure 4:
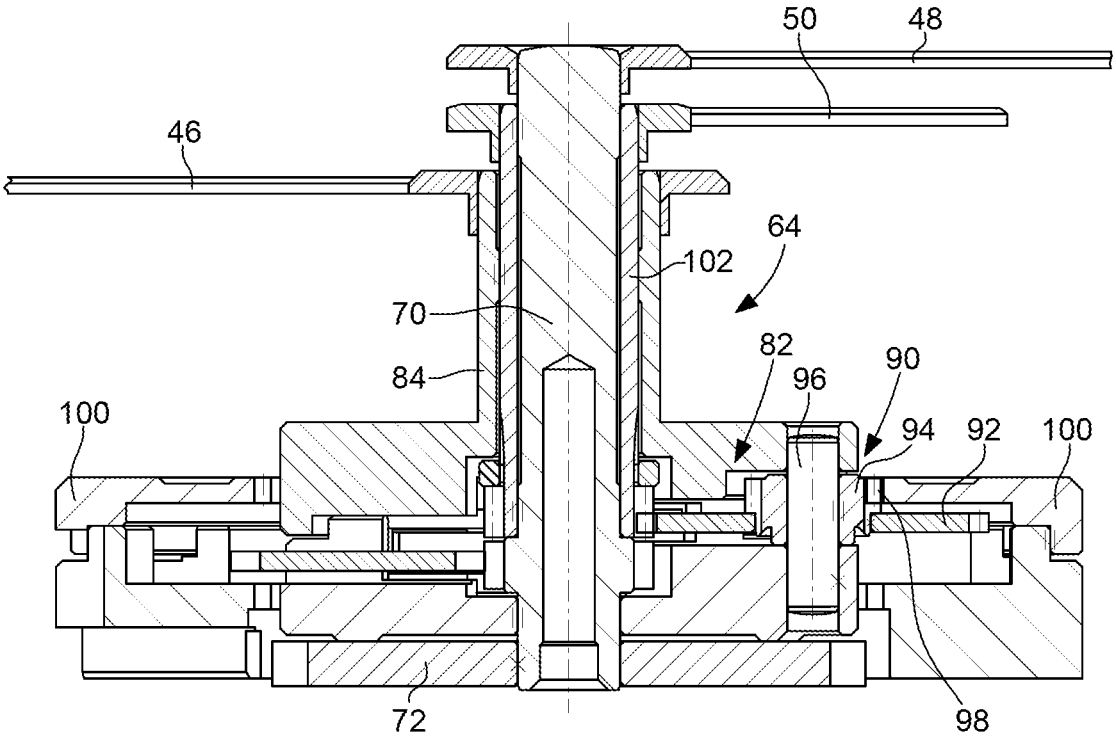
FIG. 4 is a cross-sectional view along line B-B of FIG. 2.

As seen in FIG. 4, a planetary multiplier wheel set 90 is formed of a second planetary wheel 92 and a second planetary pinion 94 integral with second planetary wheel 92. Planetary multiplier wheel set 90 is freely mounted about a second pin 96 driven into upper differential frame 82 which is integral with civil hour pipe 84. When civil hour pipe 84 and therefore upper differential frame 82 rotate, they drive second pin 96 and consequently planetary multiplier wheel set 90, whose second planetary pinion 94 rolls over a second inner toothing 98 of a mobile differential crown wheel 100, which, as will be seen below, is in mesh with equation of time cam 54. Second planetary wheel 92 in turn drives a solar time minute pipe 102, on which is pressed true minute hand 50. The right choice of gear ratios between civil hour pipe 84, second planetary wheel 92, second planetary pinion 94 and mobile differential crown wheel 100 produces a multiplication-by-twelve between the hours of civil time and the minutes of true time and the true time display is thus obtained. In other words, by a multiplication-by-twelve, planetary multiplier wheel set 90 makes it possible to change from the civil hour to the true solar minute.

It follows from the above that planetary reducer wheel set 74 and planetary multiplier wheel set 90 rotate on themselves describing a circular trajectory centred on civil minute pipe 70. Preferably, planetary reducer wheel set 74 and planetary multiplier wheel set 90 move on a circle of the same radius, centred on the civil minute pipe, angularly spaced apart from each other.

The pivoting of mobile differential crown wheel 100 is controlled by equation of time lever 68, provided with a feeler beak 106 via which equation of time lever 68 is in contact with the profile of equation of time cam 54. This equation of time lever 68 is held elastically bearing on the profile of equation of time cam 54 by a spring 108. This equation of time lever 68 is also provided with a first tooth 110 in mesh with a second corresponding tooth 112 provided on mobile differential crown wheel 100 to control the movement of the latter. It is understood that, at a moment close to midnight, when the calendar mechanism changes the date, it causes date wheel 58 to advance one step. During this brief moment when the date change occurs, upper differential frame 82 and therefore civil hour pipe 84 may be considered to be immobile. By pivoting, mobile differential crown wheel 100 drives second planetary pinion 94 and thus second planetary wheel 92, which, in turn, meshes with solar minute pipe 102 onto which is pressed true minute hand 50. The position of true minute hand 50 is thus set for the next day.

Figure 5:
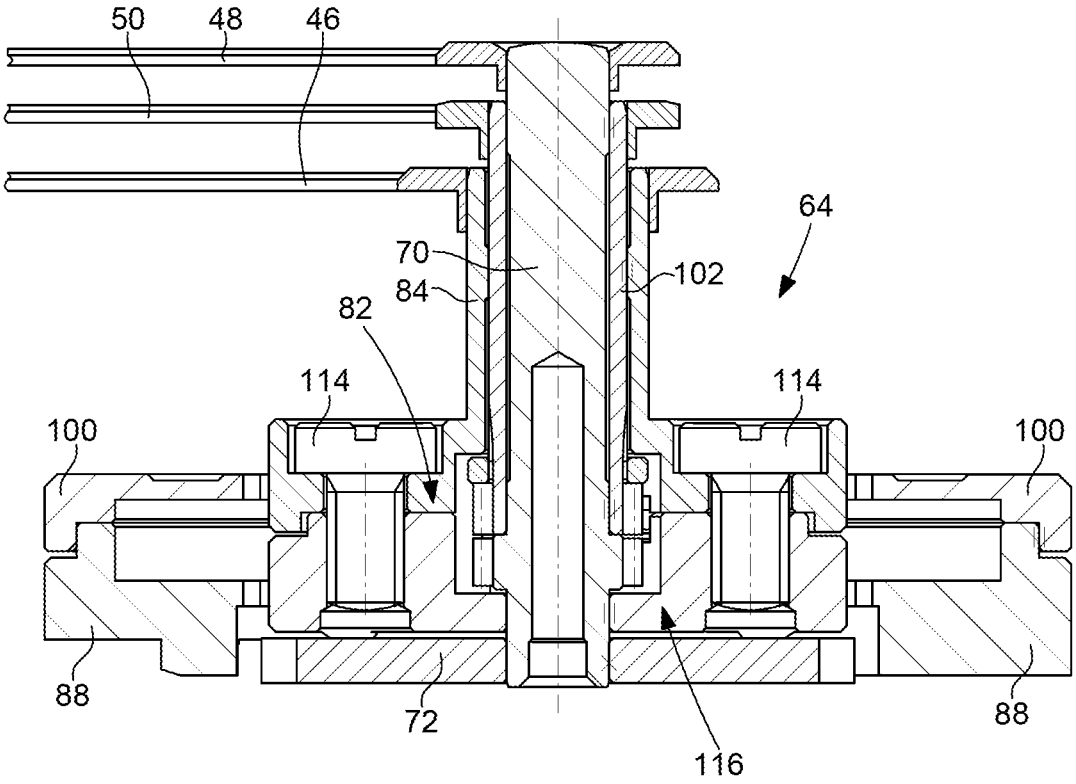
FIG. 5 is a cross-sectional view along line C-C of FIG. 2.

Referring now to FIG. 5, it can be seen that at least one and preferably two screws 114 allow upper differential frame 82 to be closed onto a lower differential frame 116. The upper and lower differential frames 82 and 116 therefore rotate together when differential gear device 64 according to the invention is operating.

It goes without saying that this invention is not limited to the embodiment that has just been described and that various simple modifications and variants can be envisaged by those skilled in the art without departing from the scope of the invention as defined by the annexed claims.

NOMENCLATURE

1. Equation of time cam
2. Month disc
4. Solar minute hand
6. Date wheel set
8. Hand
10. Intermediate date wheel
12. Reducer wheel set
14. Differential gear device
18. Civil minute hand
20. Rack
22. Planetary pinions
24. Inner toothing
26. Equation of time wheel
28. First toothed sector
30. Second toothed sector
32. Feeler spindle
34. Solar time display pinion
38. Solar time display wheel
40. Cannon-pinion
42. Centre
44. Running equation of time mechanism
46. Civil hour hand
48. Civil minute hand
50. True minute hand
52. Astrological symbol of the sun
54. Equation of time cam
56. Equation of time wheel
58. Date wheel
60. Intermediate date wheel
62. Reducer wheel set
64. Differential gear device
66. Wheel set
68. Equation of time lever
70. Civil minute pipe
72. Cannon-pinion
74. Planetary reducer wheel set
76. First planetary wheel
78. First planetary pinion
80. First pin
82. Upper differential frame
84. Civil hour pipe
86. First inner toothing
88. Immobile differential crown wheel
90. Planetary multiplier wheel set
92. Second planetary wheel
94. Second planetary pinion
96. Second pin
98. Second inner toothing
100. Mobile differential crown wheel
102. True minute pipe
104. Date indicator
106. Feeler beak
108. Spring
110. First tooth
112. Second tooth
114. Screw

What is claimed is:

1. A running equation of time mechanism comprising:

a hand arrangement whose purpose is to indicate civil time by a concentric civil hour hand and civil minute hand, and a true minute hand concentric with the civil time hands, an equation of time cam having a profile which is determined by a difference, on each day of the year, between civil time and true time, wherein the equation of time cam is driven in rotation at the rate of one revolution per year by a timepiece movement, wherein the position of the true minute hand is determined by the position of the equation of time cam, and a differential gear device, a first input of which is formed by a cannon-pinion integral with a civil minute pipe on which the civil minute hand is pressed, and a second input of which is formed by the equation of time cam, wherein the differential gear device is arranged concentrically with respect to the true minute hand.

2. The running equation of time mechanism of claim 1, wherein an end of the true minute hand includes an astrological symbol.

3. The running equation of time mechanism of claim 1, wherein the second input includes an equation of time lever provided with a feeler beak that directly contacts the equation of time cam.

* * * * *